United States Patent [19]

Schulze

[11] 4,195,960

[45] Apr. 1, 1980

[54] CONVEYOR WITH DOWNWARD STEP FOR STACKED SHEETS OF FILM MATERIAL

[75] Inventor: Ehrhart Schulze, Fellbach, Fed. Rep. of Germany

[73] Assignee: Karl-Heinz Stiegler, Stuttgart, Fed. Rep. of Germany

[21] Appl. No.: 944,010

[22] Filed: Sep. 20, 1978

[30] Foreign Application Priority Data

Oct. 18, 1977 [DE] Fed. Rep. of Germany ..... 2746670

[51] Int. Cl.[2] ..... B65H 35/00

[52] U.S. Cl. ..... 414/49; 198/422; 271/213

[58] Field of Search ..... 271/182, 202, 203, 213, 271/216, 270; 214/6.5; 198/422, 423; 414/48, 49

[56] References Cited

U.S. PATENT DOCUMENTS 4,043,458 8/1977 Schott, Jr. ..... 271/213 X

FOREIGN PATENT DOCUMENTS 1461107 1/1977 United Kingdom .

*Primary Examiner*—Robert W. Saifer

*Attorney, Agent, or Firm*—Thomas R. Morrison

[57] ABSTRACT

A step in a film bag conveyor for a bag making machine protects the unwelded ends of a stack of film bags being conveyed away from disturbance by web support air jets. The step optionally permits the welded bag ends to overhang and thereby reduce stack height.

14 Claims, 2 Drawing Figures

CONVEYOR WITH DOWNWARD STEP FOR STACKED SHEETS OF FILM MATERIAL

BACKGROUND OF THE INVENTION

The present invention relates to an apparatus for stacking sheet material articles which can be fed to the stacking plate of a stacking platform, said stacking platform being formed at least partially by the upper course of at least one conveyor belt, said conveyor belt being in a resting position during stacking and which is moved for one conveying increment after formation of a stack, in order to at least partially transport the stack from the stacking place. The invention specifically relates to apparatus for stacking plastic bags which are deposited on a stack on a stacking platform from an intermittently operating bottom welding bag-making machine. In bag-making machines of this kind, the web fed to the welding station for welding is supported by means of blow air. As soon as an allowed number of bags are stacked on the stacking place, the stack thus formed is released for forward movement by one conveying increment. Then, supported by blow air, additional web is fed to the welding station of the bag making machine to continue making bags. It is unavoidable that the blow air also blows into the stack released for the conveying increment and causes it to be disturbed.

SUMMARY OF THE INVENTION

It is the object of the invention to provide an apparatus for stacking sheet material articles in which the stack released for the conveying increment cannot be disturbed by the air jets from the machine.

This object is achieved, in accordance with the present invention, by forming the stack on a stacking platform which has at least one step. The distance of the step from the rear boundary of the stack is at most as great as the conveying increment of the conveyor belt. The height of the step is at least as great as the height of the stack to be transported away. By positioning this step at a distance from the trailing edge of the stack which is at the most as great as the conveying increment of the conveyor belt, the trailing edge of the stack is carried over the step during the conveying increment and is thus lowered from the step. Since the height of the step is at least as great as the height of the stack to be transported away, the step therefore protects the stack from blow air streaming in the conveying direction. The step can here be formed by at least two reversals of the upper conveyor course. The distance of the step from the rear boundary of the stacking place is less than the length of the bags measured in the conveying direction of the conveyor belt. This has the advantage that the leading edges of the sheet material articles projects over the step. In the plastic bag making machines mentioned above, the manufactured bags are guided to the stacking place with the welded bottom leading. The individual bags have distortions in the area of the weld, so that the height of the stack at its front end is several times greater than that of the unwelded area. When the distance of the step from the rear boundary of the stacking place is less than the length of the bags, the thickened leading edge of the stack hangs over the step. Disturbances caused by the aforementioned thickness distortions in the area of the weld do not add to the height of the stack. For especially long bags, it may be expedient to form the step with a firm supporting area which extends in the conveying direction of the conveyor belt for only a fraction of the dimension of the sheet material article measured in this direction. Thus the greater part of the stack lies on the conveyor belt and only its rear edge is supported by the firm supporting surface. This is advantageous because the length of the conveying increment must be only a fraction of the length of the bag in order to convey the rear end of the stack over the step. By significantly shortening the length of the conveying increment the pauses in bag forming during transportation of the stack can be significantly shortened. This is especially disirable with specially long sheet material articles. The stacks then lie like overlapping fish scales on the conveyor belt in which the total height of the stack increases with the growing distance from the rear boundary on the stacking place. In order to reduce stack height due to weld distortions, a second step can be provided which is formed by two reversals of the course of the conveyor belt. The second step is located closer to the rear boundary of the stack than the dimension of the sheet material article measured in the conveying direction of the conveyor belt. Therefore all the thickened front ends of the various stacks lying like overlapping fish scales on each other are beyond the step, and thus do not contribute to the total height of the superimposed stacks.

Another advantageous complement of the above described embodiment of the invention involves mounting the step displaceable and fastenable for adjusting its distance from the rear boundary of the stacking place. The possibility therefore exists for adapting the step to the various lengths of the sheet material articles and/or varying sizes of conveying increment.

DETAILED DESCRIPTION OF THE PREFERRED EMBODIMENT

Figure 1:
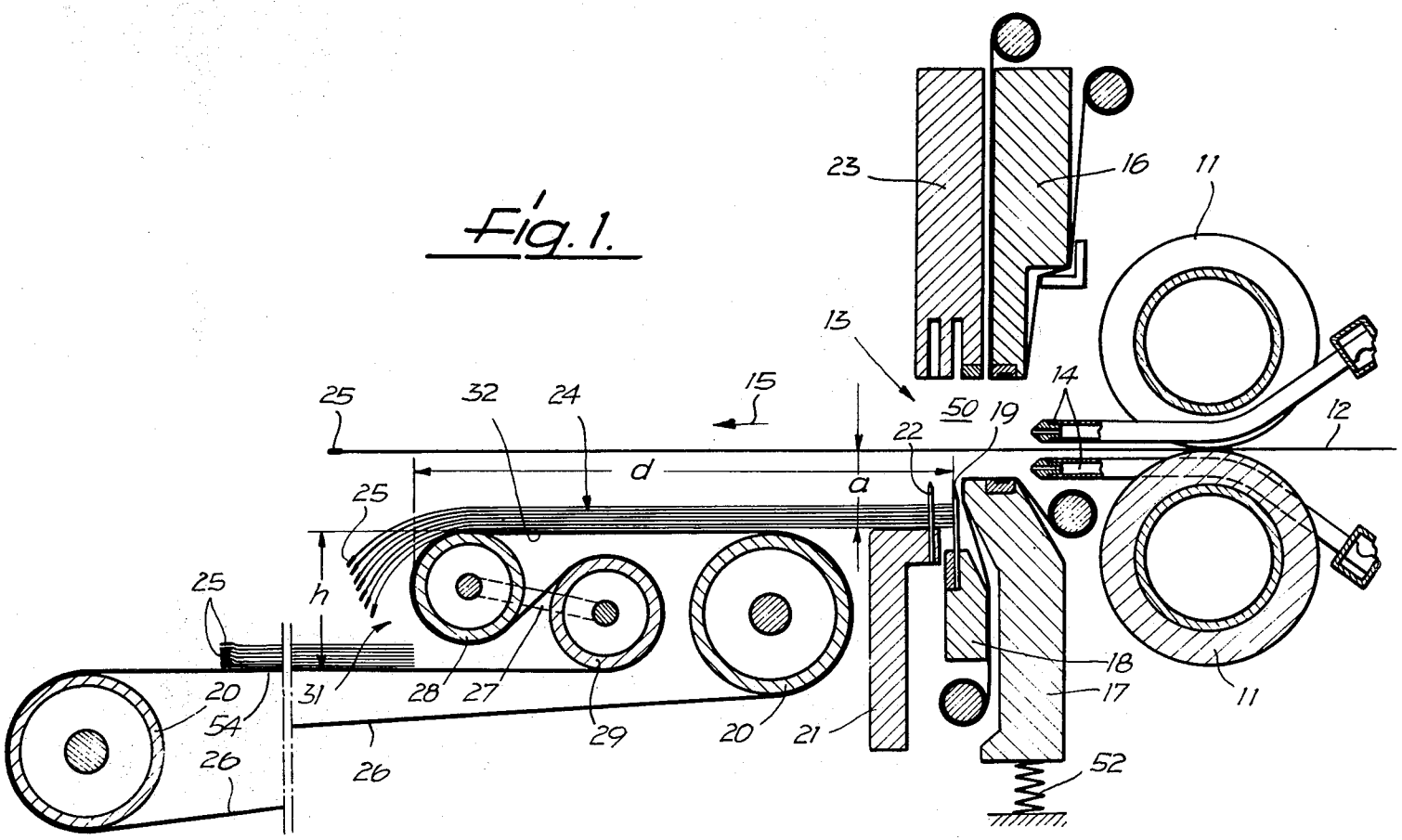
FIG. 1 is a longitudinal section of a first embodiment of the invention with part of the welding station of a bag making machine.

In the right part of FIG. 1, the parts of the welding station 13 of a bag making machine are shown. In the pressure gap 50 between two feed rolls 11, a web 12 consisting of a compressed tube of a thermoplastic material is intermittently fed into the welding station 13 for the length of the desired bag. So that the fed end section of the web lies smoothly, blow pipes 14 are provided which produce streams of air aimed in the conveying direction 15. In the welding station 13, there are positioned an upper welding bar 16, a bottom welding bar 17, a knife bar 18 for a separating knife 19, a needle bar 21 for a row of needles 22 and above these, a clamping bar 23. The bottom welding bar 17 is mounted movable downward against the tension of a spring 52. The needle bar 21 is mounted movable down from and back to the position shown and is connected to a drive (not shown) which moves the needles 22 downward to release the stack 24 at the end of a stacking sequence. The upper welding bar 16 and the clamping bar 23 are movable by a drive (not shown) downward from the position shown, and back again to form each bag. During stoppage of the intermittent feed of the web 12, the bars 16 and 23 are moved downward so that a bag is separated by the knife 19 and is affixed to the needles 22 through the clamping bar 23. Simultaneously, a bottom weld 25 of the next bag is welded at the so-formed new end of the web 12 by the welding bars 16 and 17. In this manner, a stack 24 of bags is formed which is held together by the needles 22, the bottom welds 25 of the bags being on the front ends away from the needles 22.

The upper course of an endless conveyor belt 26 running on rolls 20 forms a stacking platform 54 for the stack 24. The upper course of conveyor belt 26 is reversed over two rolls 28 and 29 mounted between side bars 27, so that a step 31 with height h is formed which partitions off a stacking place 32 from the stacking platform 54 formed by the upper course of the conveyor belt 26. The rear end of the stacking place 32 is defined by the separating knife 19. The distance d of the step 31 from the rear boundary of the stacking place 32 is as great as the conveying increment of the conveyor belt 26 and slightly less than the dimension, measured in the conveying direction of the conveyor belt, of the individual bags of the stack 24, but is preferably about two-thirds of the bag dimension, so that the bottoms of the bags hang over the step 31 as shown in FIG. 1. The height h of the step 31 is greater than the height of the stack 24 to be transported away.

The bag making machine is adjusted so that when a certain number of bags have been stacked in the stack, immediately after cutting off and affixing the last bag onto the needles 22, the blowing air from blow pipes 14 is stopped, the needle bar 21 is moved downward freeing the stack 24 for the intermittent feed of the conveyor belt for one conveying increment. Since this conveying increment corresponds to distance d, the stack 24 is conveyed until its rear end slips off the step 31 and lies on the stacking platform 54 formed by the conveyor belt 26. The conveyance of the web 12 is again started and air is again blown through blow pipes 14. The stack lowered onto the stacking platform 54 is protected by the step 31 from the air blown from the blow pipes 14.

Because the distance d of the step from the rear boundary of the stacking place is less than the length of the bag, the thickened end of the stack hangs over the step. Therefore, the area above the stack remains free. This permits positioning the stacking place at a distance a below the web 12, where the distance a is just slightly greater than the height of the fully stacked-up stack 24. By reducing distance a to a minimum, fluttering of said web in the jet of the blow pipes 14 is avoided.

Figure 2:
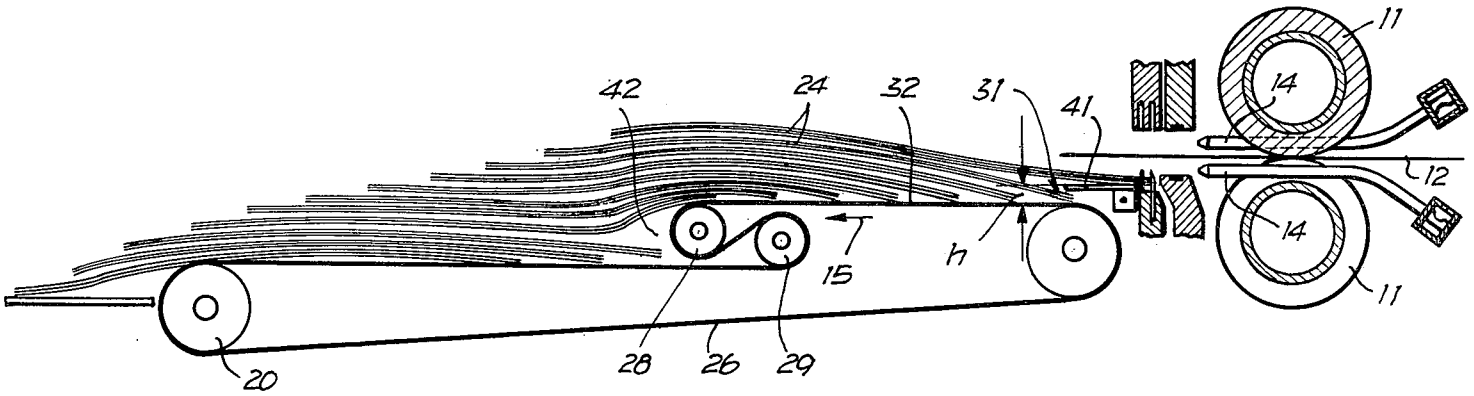
FIG. 2 is a section, corresponding to FIG. 1, of the second embodiment of the invention.

In the embodiment shown in FIG. 1, conveyance of the web 12 is interrupted during the removal of the finished stacks 24 until the conveyor belt has completed a conveying increment which is about two-thirds of the length of the whole bag. With long bags, this embodiment may require an unacceptable delay. The embodiment shown in FIG. 2, in which those parts corresponding to the parts of the preceding embodiment are marked with the same reference numerals, keeps this delay as short as possible.

A plate 41 forming a firm supporting surface is provided for the formation of the step 31. The plate 41 extends in the conveying direction 15 of the conveyor belt 26 for less than half the length of a bag and preferably for only a fraction of the length of a bag. The height h of this step above the stacking place 32 is, as in the preceding embodiment, greater than the height of the single stack 24. The conveying increment of the conveyor belt 26 is only as great as the length of the plate 41 measured in the conveying direction. Since this length is much shorter than the length of the bags, bag formation need only be interrupted for a short time. The stacks transported away hereby overlap one another like fish scales.

In this embodiment, the step formed through the reversal of the upper course of the conveyor belt 26 by means of rolls 28 and 29 could be omitted. This step, as second step 42, is advantageous in this embodiment in order that the total height of the superimposed stacks, caused by the overlapping of the stacks 24, can be significantly reduced. Just like the step 31 in the embodiment according to FIG. 1, this second step 42 is positioned at a distance from the rear boundary of the stacking place 32, slightly less than the length of the bag, but preferably two-thirds of the latter. In this way the thickened portion of the newest stack caused by the distortions in the area of the bottom welds hangs over the second step 42. This has the same advantage of reducing the height a as in the first embodiment.

In order to be able to adapt both of the mentioned apparatus to bags of various lengths, both rolls 28 and 29 may be mounted on slides not shown in the drawing. The slides may be clampable and movable back and forth between the rolls 20, so that the step 31 in the embodiment according to FIG. 1 and the second step 42 in the embodiment according to FIG. 2 can be horizontally displaced and adjusted to the respective length of the bag.

It will be understood that the claims are intended to cover all changes and modifications of the preferred embodiments of the invention, herein chosen for the purpose of illustration which do not constitute departures from the spirit and scope of the invention.

What is claimed is:

1. Apparatus for stacking and transporting sheet material comprising:

(a) a conveyor belt;

(b) a stacking place for stacking said sheet material at least partly on said conveyor belt;

(c) at least one downward step at the end of said stacking place;

(d) moving means for moving said conveyor belt a conveyor increment at least as far as the distance from said the trailing end of a stack of sheet material on said stacking place to the edge of said step whereby said trailing end is moved over said step; and (e) the height of said step exceeding the height of said stack.

2. Apparatus in accordance with claim 1, wherein said step is formed by at least two reversals of the upper course of the conveyor belt and the distance of the step from the rear boundary of the stacking place is less than the dimension of the sheet material article measured in the conveying direction of the conveyor belt.

3. Apparatus in accordance with claim 2, wherein the distance of the step from the rear boundary of the stacking place is about two-thirds of the length of said sheet material.

4. Apparatus in accordance with claim 2, wherein the reversal is formed through at least two reversing rolls partially around which the upper course of the conveyor belt is guided.

5. Apparatus in accordance with claim 1, wherein the step comprises a fixed supporting surface which extends in the conveying direction of the conveyor belt for less than half the dimension of the sheet material measured in this direction.

6. Apparatus in accordance with claim 1, wherein said at least one step is at lest first and second steps in sequence in the conveying direction.

7. Apparatus in accordance with claim 1, wherein the step is mounted displaceable and fastenable for adjustment of its distance from the rear boundary of the stacking place.

8. Apparatus for transporting stacked sheet material in a discontinuous process comprising:

(a) stacking means for supporting said stacked sheet material;

(b) said stacking means having at least one downward step therein;

(c) said downward step having a height exceeding the height of said stack; and (d) conveying means for moving a stack of said stacked sheet material for a distance increment at least as long as the distance from said downward step to the trailing edge of said stack before moving whereby said trailing edge drops off said downward step.

9. Apparatus in accordance with claim 8, further comprising said step being located closer to the trailing edge of said stack before moving than the length of said sheet material whereby the leading edge of said sheet material hangs over said step.

10. Apparatus for transporting stacked sheet material in a discontinuous process comprising:

(a) stacking means for supporting said stacked sheet material;

(b) said stacking means having at least one downward step therein;

(c) conveying means for moving a stack of said stacked sheet material for a distance increment at least as long as the distance from said downward step to the trailing edge of said stack before moving whereby said trailing edge drops off said downward step; and (d) said distance increment being less than the length of said sheet material whereby succeeding stacks partially overlay one another like fish scales.

11. Apparatus in accordance with claim 10, further comprising a second step between said at least one step and the leading edge of said stack before moving whereby said leading edge hangs over said second step.

12. Apparatus in accordance with claim 11, further comprising:

(a) said conveying means having a conveyor belt;

(b) said at least one step being a fixed supporting surface under at least the trailing portion of said stack; and (c) said second step being at least two reversing rolls partially around which an upper course of said conveyor belt is wrapped.

13. In the environment of a bag forming machine for forming bags of plastic film wherein a flattened tubular web of film is conveyed by air jets over a stacking place and severing and sealing means severs and seals across the tubular web and holding means holds the trailing edge of each newly formed bag atop a stack, said holding means being operative to release the trailing edges of all bags in said stack a predetermined time when the trailing edge of said stack has a predetermined height and wherein a discontinuously operating conveying means conveys said stack a conveying increment away from said severing and sealing means following said predetermined time, the improvement comprising:

(a) said conveying means being a conveyor belt;

(b) first and second parallel spaced apart rolls;

(c) an upper course of said conveyor belt being reversed around said first and second rolls and forming a downward step in the conveying direction;

(d) said downward step being located between the leading and trailing edges of said stack; and (e) the height of said downward step exceeding said predetermined height.

14. In the environment of a bag forming machine for forming bags of plastic film wherein a flattened tubular web of film is conveyed by air jets over a stacking place and severing and sealing means severs and seals across the tubular web and holding means holds the trailing edge of each newly formed bag atop a stack, said holding means being operative to release the trailing edges of all bags in said stack a predetermined time when the trailing edge of said stack has a predetermined height and wherein a discontinuously operating conveying means conveys said stack a conveying increment away from said severing and sealing means following said predetermined time, the improvement comprising:

(a) said conveying means being a conveyor belt;

(b) first and second parallel spaced apart rolls;

(c) an upper course of said conveyor belt being reversed around said first and second rolls and forming a first downward step in the conveying direction;

(d) said first downward step being located between the leading and trailing edges of said stack;

(e) another downward step between said first downward step and said trailing edge;

(f) the height of said other downward step exceeding said predetermined height; and (g) said conveying increment being greater than the distance from the stack trailing edge to said other step and substantially less than the length of said bags whereby succeeding stacks partially overlay each other like fish scales.

* * * * *